US011434816B2

(12) United States Patent
Jordan et al.

(10) Patent No.: US 11,434,816 B2
(45) Date of Patent: Sep. 6, 2022

(54) THERMAL BARRIER COATINGS FOR INTERNAL COMBUSTION ENGINES

(71) Applicant: The University of Connecticut, Farmington, CT (US)

(72) Inventors: Eric Jordan, Storrs, CT (US); Chen Jiang, Willimantic, CT (US); Rishi Kumar, Ashford, CT (US); Balakrishnan Nair, Sandy, UT (US)

( * ) Notice: Subject to any disclaimer, the term of this patent is extended or adjusted under 35 U.S.C. 154(b) by 0 days.

(21) Appl. No.: 17/505,759

(22) Filed: Oct. 20, 2021

(65) Prior Publication Data

US 2022/0034257 A1 Feb. 3, 2022

Related U.S. Application Data

(63) Continuation of application No. 17/014,992, filed on Sep. 8, 2020.

(60) Provisional application No. 62/897,184, filed on Sep. 6, 2019.

(51) Int. Cl.
*F02B 77/02* (2006.01)
*F02B 77/11* (2006.01)
*F02F 3/12* (2006.01)

(52) U.S. Cl.
CPC ..... *F02B 77/11* (2013.01); *F02F 3/12* (2013.01); *F05C 2203/08* (2013.01); *F05C 2251/048* (2013.01); *F05C 2253/12* (2013.01)

(58) Field of Classification Search
CPC ... C23C 28/3215; C23C 28/345; C23C 4/134; C23C 14/08; C23C 24/085; C23C 28/022; C23C 28/30; C23C 4/073; F01D 5/288; F01D 5/284; F02B 77/02; F02B 2023/061
See application file for complete search history.

(56) References Cited

U.S. PATENT DOCUMENTS 5,876,860 A * 3/1999 Marijnissen ..... C23C 28/3215 428/629
6,284,323 B1 * 9/2001 Maloney ..... C23C 28/3455 427/419.1
6,440,575 B1 * 8/2002 Heimberg ..... C23C 28/042 428/472
6,764,771 B1 * 7/2004 Heimberg ..... C23C 30/00 428/472
2017/0089260 A1 * 3/2017 Bookbinder ..... B32B 15/16
2019/0194812 A1 * 6/2019 Walker ..... C22C 9/04
2019/0195126 A1 * 6/2019 Schaedler ..... C23C 4/129

OTHER PUBLICATIONS

Baharlou "International Preliminary Report on Patentability" PCT Application No. PCT/US20/49771, (dated Mar. 8, 2022) 6 pages.

* cited by examiner

*Primary Examiner* — Long T Tran
(74) *Attorney, Agent, or Firm* — Intellectual Strategies

(57) ABSTRACT

A thermal barrier coating for an internal combustion engine includes an insulating thermal spray coating, where a chosen material of the insulating thermal spray coating has a thermal conductivity lower than 2 W/mK in fully dense form and the chosen material includes a coefficient of thermal expansion within 5 ppm/K of a coefficient of thermal expansion of a material of a component of the internal combustion engine upon which the coating is placed.

20 Claims, 3 Drawing Sheets

THERMAL BARRIER COATINGS FOR INTERNAL COMBUSTION ENGINES

CROSS-REFERENCES TO RELATED APPLICATIONS

This application claims the benefit of U.S. Provisional Patent Application No. 62,897,184 entitled "THERMAL BARRIER COATINGS FOR INTERNAL COMBUSTION ENGINES" and filed on Sep. 6, 2019 for Eric Jordan et al., which is incorporated herein by reference.

STATEMENT OF FEDERALLY SPONSORED RESEARCH

This invention was made with Government support under DE-SC0019865 and DE-EE0007817 awarded by Department of Energy. The Government has certain rights to this invention.

FIELD

Embodiments of methods and apparatuses are described to make thermal barrier coatings.

BACKGROUND

Automobile and truck internal combustion (IC) engines dominate the ground transportation sector in the US (and globally), annually transporting 11 billion tons of freight and logging 3 trillion vehicle miles. Improvement to the fuel efficiency of IC engines reduces environmental impact and can yield large economic benefits, both to the end users (i.e., the operators of IC engine powered vehicles) and to the competitiveness of engine manufacturers across the world. Although U.S. federal regulations currently incentivize electric vehicles and the penetration of electric vehicles is expected to increase in the future, IC engines are anticipated to remain as the primary energy conversion technology in vehicle application to 2040 and beyond in nearly all projections.

In IC engines, a large fraction of the heat generated during combustion is transferred to the pistons, the head, and the cylinder liner, and ultimately dissipated by the engine coolant. These direct heat losses to the combustion chamber walls reduce the power generated, and consequently, the efficiency of IC engines. Thermal barrier coatings (TBCs) can be used to address this issue. By coating the engine components that define the combustion chamber with TBCs, heat losses can be substantially reduced, thereby providing higher temperatures and pressures after combustion and throughout expansion. The higher pressures during expansion increase work extraction improving thermal efficiency. In addition, low thermal inertia TBCs provide rapid surface temperature response which will reduce time to catalyst light-off, resulting in lower unburned hydrocarbon (UBHC) and carbon monoxide (CO) emissions during a cold-start. Embodiments described herein provide the above enhanced improvements.

SUMMARY

The subject matter of the present application has been developed in response to the present state of the art, and in particular, in response to the problems and disadvantages associated with conventional thermal barrier coatings that have not yet been fully solved by currently available techniques. Accordingly, the subject matter of the present application has been developed to provide embodiments that overcome at least some of the shortcomings of prior art techniques.

Disclosed herein is a thermal barrier coating for an internal combustion engine. The thermal barrier coating includes an insulating thermal spray coating, where a chosen material of the insulating thermal spray coating has a thermal conductivity lower than 2 W/mK in fully dense form and the chosen material includes a coefficient of thermal expansion within 5 ppm/K of a coefficient of thermal expansion of a material of a component of the internal combustion engine upon which the coating is placed. The preceding subject matter of this paragraph characterizes example 1 of the present disclosure.

The insulating thermal spray coating comprises a perovskite material. The preceding subject matter of this paragraph characterizes example 2 of the present disclosure, wherein example 2 also includes the subject matter according to example 1, above.

The perovskite material is of the $A_2B_2O_9$ category, where A and B are cations. The preceding subject matter of this paragraph characterizes example 3 of the present disclosure, wherein example 3 also includes the subject matter according to any one of examples 1-2, above.

The insulating thermal spray coating comprises lanthanum molybdate ($La_2Mo_2O_9$). The preceding subject matter of this paragraph characterizes example 4 of the present disclosure, wherein example 4 also includes the subject matter according to any one of examples 1-3, above.

The insulating thermal spray coating comprises lanthanum molybdate ($La_2Mo_2O_9$) with at least one dopant, wherein the dopant is one of Bi, Ni, Rb, Y, Gd, Nd, Ba, Sr, Ca. The preceding subject matter of this paragraph characterizes example 5 of the present disclosure, wherein example 5 also includes the subject matter according to any one of examples 1-4, above.

The insulating thermal spray coating comprises gadolinium zirconate ($Gd_2Zr_2O_7$). The preceding subject matter of this paragraph characterizes example 6 of the present disclosure, wherein example 6 also includes the subject matter according to any one of examples 1-5, above.

The insulating thermal spray coating comprises lanthanum strontium cobalt ferrites, of the type $La_ySr_{1-y}Co_{1-x}Fe_xO_3$ oxides. The preceding subject matter of this paragraph characterizes example 7 of the present disclosure, wherein example 7 also includes the subject matter according to any one of examples 1-6, above.

The x=0.4. The preceding subject matter of this paragraph characterizes example 8 of the present disclosure, wherein example 8 also includes the subject matter according to any one of examples 1-7, above.

The insulating thermal spray coating comprises a material from the sodium zirconium phosphate ("NZP") class of ceramics that have a single crystal coefficient of thermal expansion below 5 ppm/K. The preceding subject matter of this paragraph characterizes example 9 of the present disclosure, wherein example 9 also includes the subject matter according to any one of examples 1-8, above.

The material from the sodium zirconium phosphate ("NZP") class of ceramics is one of $Sr_{0.5}Hf_2(PO_4)_3$, $Sr_{0.5}Zr_2(PO_4)_3$, $Ca_{0.25}Sr_{0.25}Zr_2(PO_4)_3$, $CsHf_2(PO_4)_3$, $Ca_{0.25}Sr_{0.25}Zr_2(PO_4)_3$, $Cs_{1.3}Gd_{0.3}Zr_{1.7}(PO_4)_3$. The preceding subject matter of this paragraph characterizes example 10 of the present disclosure, wherein example 10 also includes the subject matter according to any one of examples 1-9, above.

The insulating thermal spray coating comprises calcium hexa-aluminate. The preceding subject matter of this paragraph characterizes example 11 of the present disclosure, wherein example 11 also includes the subject matter according to any one of examples 1-10, above.

The component is steel and the insulating thermal spray coating comprises a material from the sodium zirconium phosphate ("NZP") class of ceramics that have relatively low single crystal coefficient of expansion below 5 ppm/K. The preceding subject matter of this paragraph characterizes example 12 of the present disclosure, wherein example 12 also includes the subject matter according to any one of examples 1-11, above.

The material from the sodium zirconium phosphate ("NZP") class of ceramics is one of $Sr_{0.5}Hf_2(PO_4)_3$, $Sr_{0.5}Zr_2(PO_4)_3$, $Ca_{0.25}Sr_{0.25}Zr_2(PO_4)_3$, $CsHf_2(PO_4)_3$, $Ca_{0.25}Sr_{0.25}Zr_2(PO_4)_3$, $Cs_{1.3}Gd_{0.3}Zr_{1.7}(PO_4)_3$. The preceding subject matter of this paragraph characterizes example 13 of the present disclosure, wherein example 13 also includes the subject matter according to any one of examples 1-12, above.

The thermal barrier coating includes surface treatments through application of a top layer to enhance smoothness or enhance erosion resistance or reduce surface porosity. The preceding subject matter of this paragraph characterizes example 14 of the present disclosure, wherein example 14 also includes the subject matter according to any one of examples 1-13, above.

The thermal barrier coating includes a material to absorb thermal radiation at or near a surface of the insulating thermal spray coating. The preceding subject matter of this paragraph characterizes example 15 of the present disclosure, wherein example 15 also includes the subject matter according to any one of examples 1-14, above.

The material to absorb thermal radiation is one of Phosphor bonded $Al_2O_3$, Phosphor bonded Cr or Fe doped $Al_2O_3$, Phosphor bonded $SiO_2$, Phosphor bonded Cr or Fe doped $SiO_2$, Phosphor bonded $ZrO_2$, Phosphor bonded Cr or Fe doped $ZrO_2$, or calcium magnesium aluminosilicate glass. The preceding subject matter of this paragraph characterizes example 16 of the present disclosure, wherein example 16 also includes the subject matter according to any one of examples 1-15, above.

The material further comprises silicon carbide or silicon nitride. The preceding subject matter of this paragraph characterizes example 17 of the present disclosure, wherein example 17 also includes the subject matter according to any one of examples 1-16, above.

The component is one of a piston crown, a combustion chamber, a valve face, an exhaust port, or an exhaust manifold section. The preceding subject matter of this paragraph characterizes example 18 of the present disclosure, wherein example 18 also includes the subject matter according to any one of examples 1-17, above.

A method for forming a thermal barrier coating is disclosed. The method includes applying an insulating thermal spray coating where a chosen material of the insulating thermal spray coating has a thermal conductivity lower than 2 W/mK in fully dense form and the chosen material includes a coefficient of thermal expansion within 5 ppm/K of a coefficient of thermal expansion of a material of a component of the internal combustion engine upon which the coating is placed. The preceding subject matter of this paragraph characterizes example 19 of the present disclosure.

The method includes polishing the insulating thermal spray coating. The preceding subject matter of this paragraph characterizes example 20 of the present disclosure, wherein example 20 also includes the subject matter according to example 20, above.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
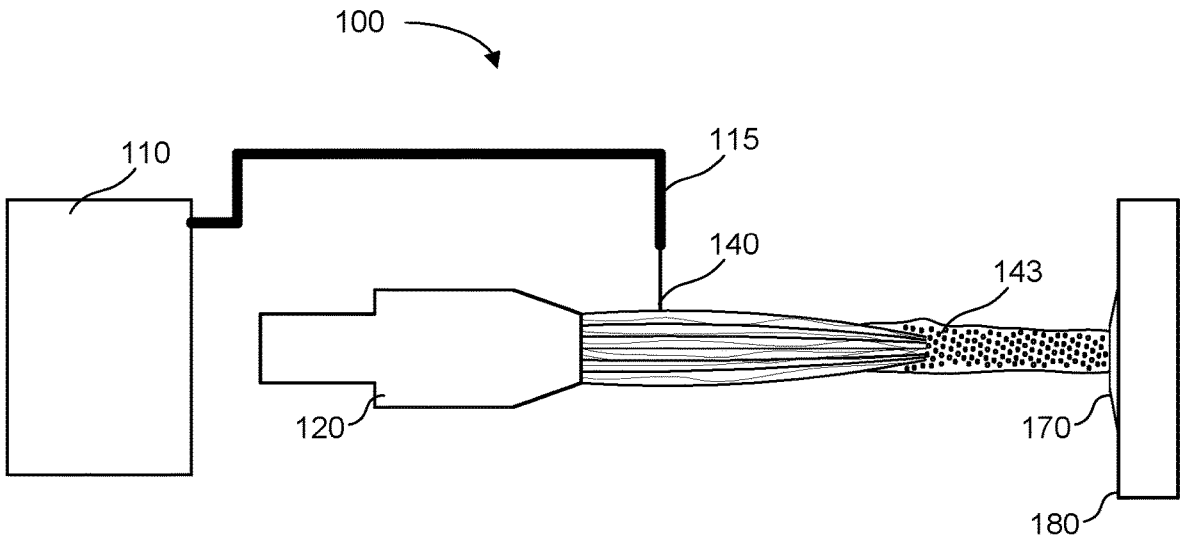
FIG. 1 depicts a schematic diagram illustrating an embodiment of a thermal barrier coating in accordance with one or more embodiments of the present invention.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

As discussed above, automobile and truck IC engines dominate the ground transportation sector in the US (and globally), annually transporting 11 billion tons of freight and logging 3 trillion vehicle miles. Improvement to the fuel efficiency of IC engines reduces environmental impact and can yield large economic benefits, both to the end users (i.e., the operators of IC engine powered vehicles) and to the competitiveness of engine manufacturers across the world. Although U.S. federal regulations currently incentivize electric vehicles and the penetration of electric vehicles is expected to increase in the future, IC engines are anticipated to remain as the primary energy conversion technology in vehicle application to 2040 and beyond in nearly all projections.

In IC engines, a large fraction of the heat generated during combustion is transferred to the pistons, the head, and the cylinder liner, and ultimately dissipated by the engine coolant. These direct heat losses to the combustion chamber walls reduce the power generated, and consequently, the efficiency of IC engines. TBCs can be used to address this issue. By coating the engine components that define the combustion chamber with TBCs, heat losses can be substantially reduced, thereby providing higher temperatures and pressures after combustion and throughout expansion. The higher pressures during expansion increase work extraction improving thermal efficiency. In addition, low thermal inertia TBCs provide rapid surface temperature response which will reduce time to catalyst light-off, resulting in lower unburned hydrocarbon (UBHC) and carbon monoxide (CO) emissions during a cold-start. Embodiments described herein provide the above enhanced improvements.

The use of high-performance TBCs have resulted in up to 2% relative improvement in thermal efficiency along with reduced UBHC emissions. Such results were achieved by applying embodiments described herein of an advanced TBC to the piston surface only. Efficiency benefits are amplified even more by coating the remaining combustion chambers surfaces in addition to the piston and other components of the internal combustion engine.

TBCs in IC engines have been tested in the past, as early as the 1980s, in diesel engines, with the goal of duplicating the successful use of TBCs in gas turbines. This resulted in the concept of the adiabatic engine, where the basic premise was that insulating the combustion chamber would reduce heat rejection and consequently increase work generated by the cycle. Very thick ceramic coatings (in most cases, yttria-stabilized zirconia, YSZ) were applied to the cylinder head, and the top of the piston. However, this approach was largely unsuccessful due to four fundamental flaws:

(1) the thick coatings stored heat, creating high surface temperatures throughout the cycle, which negatively impacted volumetric efficiency (i.e., charge heating), (2) most of the energy saved by reducing heat losses transitioned to exhaust losses rather than usable work, (3) the coatings had poorly matched coefficients of thermal expansion (CTE) compared to the piston which led to premature failure, and (4) the coatings were porous, and therefore absorbed and desorbed UBHC, which increased the TBC thermal conductivity and UBHC emissions.

Embodiments of the invention described herein differ significantly by elevating wall temperatures only when it matters most, i.e. during combustion and expansion, thus avoiding these negative effects.

Adoption of embodiments described herein can have broad impacts on the engines for the 80 million light-duty vehicles made worldwide. Based on spark ignition (SI) engine characteristics, the heat transfer and efficiency improvements can be realized at low to medium loads and speeds where SI efficiency is particularly low. Furthermore, such coatings also increase the exhaust gas temperatures for potential secondary energy recovery—for example, turbocharging or by utilizing emerging thermal electric technology. In addition, the propensity to knock is a unique challenge in SI engine applications; however, our approach enables us to both improve thermal efficiency and address end-gas knock, as described herein.

Previous work on thick TBCs found that higher surface temperatures increased the propensity for end-gas knock. However, if the thermal conductivity and heat capacity of a TBC are low enough, it is possible to actually reduce the surface temperature during intake and compression compared to a bare-metal surface which reduces the risk of knock. Embodiments described herein include temperature swing TBCs with appropriate properties can simultaneously improve efficiency and reduce the propensity to knock.

Additionally, a low thermal inertia coating, as embodiments herein include, can reduce emissions during cold-starts. A large fraction of the UBHC and CO emissions during a standard EPA test can be attributed to the first 60 seconds of operation. After that initial period, the catalytic converter achieves the light-off temperature and begins reacting and reducing all but trace amounts of emissions. TBCs have much lower thermal inertia than steel or aluminum, thus producing high surface temperatures soon after a cold-start along with reducing heat transfer losses, both of which will reduce the time to catalyst light-off and the cold-start emissions. Embodiments described herein improve cold-starts and improve catalytic effects of TBCs, especially on the exhaust valves, which is particularly useful in cold-starts.

Most gasoline engines in light-duty vehicles have aluminum pistons, engine blocks, and cylinder heads driven primarily by weight savings. The Al components have relatively high coefficients of thermal expansion (CTE) in the range of $20\text{-}25\times10^{-6}/°$ C. Computational work has identified a path to reducing critical stresses in the coating by matching the CTE between the TBC and the substrate. The most widely used TBC material in gas turbines has been YSZ with a CTE of $\sim11\times10^{-6}/°$ C., which is a significant mismatch compared to the substrate (aluminum) and resulted in poor durability. The majority of initial attempts at TBCs for IC engines used materials borrowed from the gas turbine industry (e.g. YSZ) requiring operating temperatures up to at least 1200° C. The operating temperatures of the SI engine are much lower, typically below 500° C. A wide range of new coating materials with more favorable properties that still exceed the 500° C. limit, but fall short of the 1200° C. Unlike gas turbines, for IC engines where temperature swing is critical and so (e.g. SI engines), minimizing thermal inertia is paramount. Thermal inertia (also referred to as effusivity, which appears in the analytical solution to transient heat transfer problems with a periodic heat flux) is defined as the square root of the product of thermal conductivity and volumetric heat capacity. It is commonly understood that both low thermal conductivity and low volumetric heat capacity are desired; thermal inertia captures the effects of both properties in a single quantity. Therefore, a new class of coating materials was required for new temperature-swing TBCs materials for SI engines, and the selection criteria were: (1) low thermal inertia (minimize $k\cdot\rho\cdot c_p$), (2) CTE as close to $20\text{-}25\times10^{-6}/°$ C. as possible, and (3) service temperature up to 500° C.

Two compositions of perovskites were explored. First, $La_{0.6}Sr_{0.4}Co_{1-x}Fe_xO_3$ (LSCF) with x=0.4 was identified. It has a reported CTE of $16.7\times10^{-6}/°$ C., and a bulk thermal conductivity in fully dense form at 500° C. of approximately 1.4 W/mK when x=0.4 yielding an effusivity of 1048 $J/m^2\text{-}K\text{-}s^{1/2}$. This is nearly a 2× reduction in effusivity compared to YSZ (1995 $J/m^2\text{-}K\text{-}s^{1/2}$ at 500° C.). In addition, another candidate was identified in perovskite: 6 mol % bismuth-doped $La_2Mo_2O_9$ (Bi-LMO) with a reported fully dense thermal conductivity of 0.66 W/m-K and a coating effusivity of 620 $J/m^2\text{-}K\text{-}s^{1/2}$ which is more than 40% lower than LSCF, 3× times lower than YSZ, and 2× lower than the highest performing coatings of GZO (effusivity of 1364 $J/m^2\text{-}K\text{-}s^{1/2}$). After processing and testing in motorcycle and automobile engines, Bi-LMO was down-selected due to its good durability in engine tests including associated water vapor and oil contaminants and its exceptionally low thermal inertia. This material is also stable up to at least 1000° C., and therefore, higher temperatures due to larger temperature swing in an SI engine will not be an issue.

In some embodiments, only piston crowns are coated. In some embodiments, other components including the cylinder head, valve faces, and the fillet and lower stem of the intake and exhaust valves are coated. Coating additional components is guaranteed to further reduce heat loss and increase efficiency. In some embodiments, the firedeck is coated which can provide additional improvements.

Embodiments of this invention relate to thermal barrier coatings in internal combustion engines.

Referring to FIG. 1, a schematic diagram 100 of a spray coating is depicted. The spray coating is applied through an air plasma spray (APS) process involving the injection of powder in a plasma plume. Although shown and described with certain components and functionality, other embodiments may include fewer or more components to implement less or more functionality. The schematic diagram includes a plasma gun 120 configured to spray a plasma. Also depicted is a powder feeder 110 and feed port 115 that is configured to feed a powder 140 precursor into the plasma spray which sprays particles 143 (sometimes molten particles) onto the substrate 180 which forms an insulating thermal spray coating 170 on the substrate.

The substrate 180 may be any component part of an internal combustion engine including but not limited to a piston crown, a combustion chamber, a valve face, an exhaust port, an exhaust manifold section, a firedeck, etc. The insulating thermal spray coating 170 may be applied to a single component or surface of an internal combustion engine or up to an entirety of an internal combustion engine.

Figure 2:
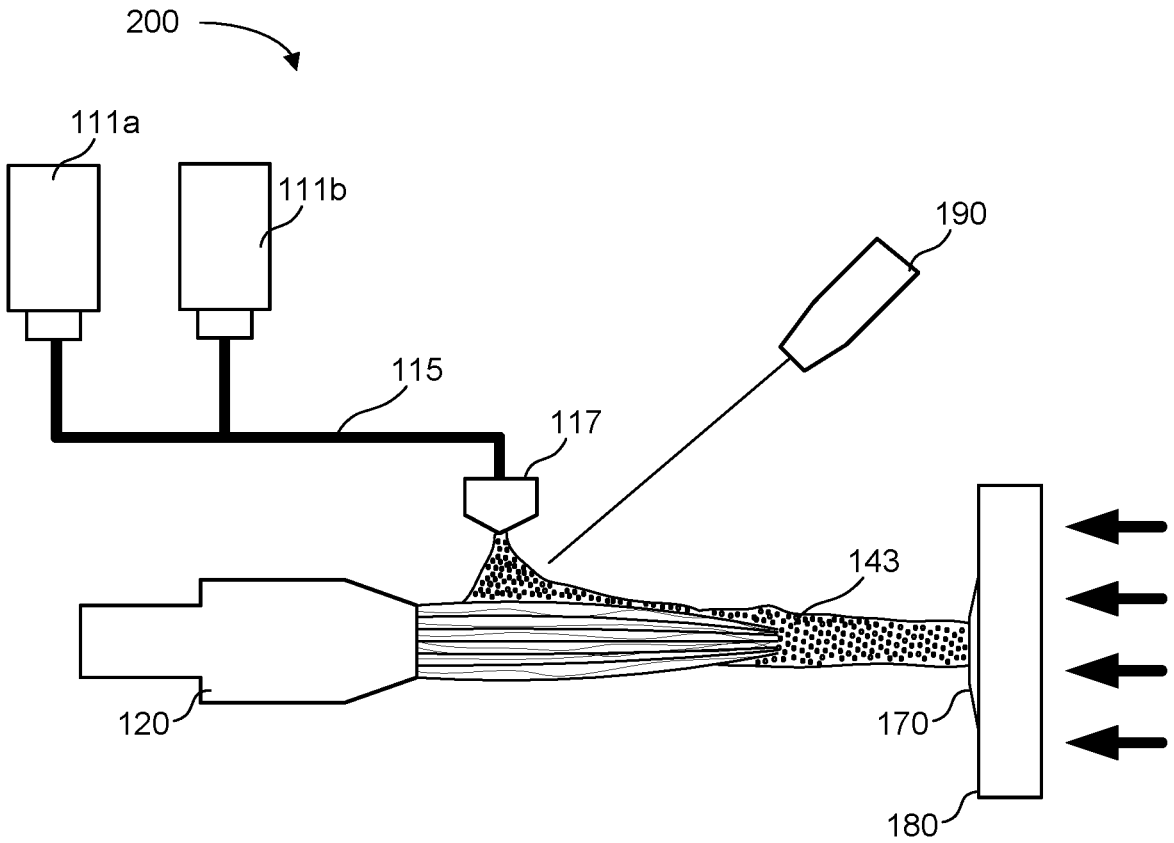
FIG. 2 depicts a schematic diagram illustrating an embodiment of a thermal barrier coating in accordance with one or more embodiments of the present invention.

Referring to FIG. 2, a schematic diagram 200 of a spray coating is depicted. The spray coating is applied through a solution precursor plasma process (SPPS). Although shown and described with certain components and functionality, other embodiments may include fewer or more components to implement less or more functionality. The schematic diagram includes a plasma gun 120 configured to spray a plasma. Also depicted are liquid reservoirs 111*a* and 111*b* which are fed via feed port 115 and injector 117 into the plasma spray. The droplets 143 are applied to the substrate 180 to form an insulating thermal spray coating 170 or just coating. Also depicted are arrows that represent a temperature control that may be applied to the substrate 180. The system may also include a monitoring device 190 that is configured to monitor the injection process.

The SPPS process injects a solution precursor into the plasma plume in place of powder used in the APS process. The SPPS process is used to rapidly spray and test new coating compositions, which allows the quick and efficient spray application of new compositions. The alternative APS process requires powders of specific size distributions to be made which takes 2 to 3 months to make per batch. This is a time consuming and expensive process when compositions have to be modified during exploratory development work.

Extensive work has been conducted since the 1980's on TBCs in automotive and truck engines, with emphasis on diesel engines. This work can be sub-divided into two distinct categories. First, the early work in the 1980s attempted to prove that the "adiabatic engine" will enable improved efficiency by eliminating heat losses. As already discussed, this hypothesis was disproven. The second category, comprised of more recent work described herein, reflects the realization that the surface "temperature-swing" effect can produce the desired heat loss reduction when it matters most, i.e. during combustion and expansion, without the negative effects on charge heating. Temperature-swing TBCs have demonstrated increased expansion work and improved thermal efficiency. These coating also increase exhaust temperature along with increasing the extracted mechanical work. Hotter exhaust can benefit aftertreatment and turbochargers.

Although occasional improvements in fuel consumption, engine durability, engine power, and emissions have been reported, much of the previously published work is for diesel combustion and TBCs have not been thoroughly investigated for SI combustion.

A second aspect of the coating properties that affects performance is surface roughness which showed that smoother surfaces improved performance. Roughness was routinely measured and is a candidate for optimization because spray parameters will influence roughness. Specifically, using smaller powder particles and as normal spray arrival angle as possible minimize surface roughness. In addition to directly helping cold start emissions, our low thermal inertia coatings reduce time to catalyst light-off and reduce cold-start emissions. Additionally, in some embodiments, thin surface catalyst coatings reduce cold-start emissions.

Economics of the deposition process will be enhanced by achieving repeatability of microstructure and consistency of microstructure over the complex part geometries. The process is reliable enough to minimize inspection requirements. Economics are also strongly affected by deposition rate and deposition efficiency.

Some embodiments include optimizing the characteristics needed for a particular performance of an engine. Variations of materials described herein provide different benefits. Options can be down-selected depending on the weighing factors that are most meaningful to the application.

The coating technology developed described here are a key technology for the improved performance of IC engines in terms of increased overall engine efficiency and reduced exhaust emissions. Considering that IC engines dominate the US ground transportation market and are expected to continue to do so for the foreseeable future, this technology will bring significant environmental and economic benefits, such as:

Energy efficiency. The 3% improvement in efficiency of IC engines will conserve a significant amount of fuel if applied to the US light-duty vehicle fleet, bringing economic benefits to the US consumers as well as environmental advantages of decreased carbon emissions.

Reduced toxic exhaust. Due to the low thermal inertia of the TBCs, the rapid temperatures change on the coating surface during cold-starts will reduce time to catalyst light-off, thereby reducing undesirable UBHC, CO emissions, and $NO_x$ emissions during a cold-start.

The competitiveness in manufacturing. Developing more efficient and environmental-friendly IC engine technology will enhance the overall competitiveness of engine manufacturers in global markets.

Energy security. The conservation of fossil fuel enabled by this novel coating technology in IC engines will strengthen energy independence of countries.

Some embodiments include significant thermal efficiency improvements that have been demonstrated for a compression ignition gasoline engine (homogeneous charge compression ignition (HCCI)) by the application of a thermal barrier coating (TBC) on the piston crown. This is accomplished by a temperature swing that reduces heat loss during the ignition part of the cycle but cools fast enough to avoid significant intake charge preheating. The desired properties of the coating are low thermal energy storage and, hence, low mass density and specific heat, low thermal conductivity and sufficient strength to withstand the pressure excursion and thermal shock. In addition, it has been shown that coating surface smoothness is important. The ideas presented herein are applicable to all gasoline compression ignition engines including but not limited to HCCI engines, diesel engines, and conventional spark ignition engines. It is recognized that aluminum engine parts have radically different thermal expansion coefficients (20+PPM/° C.) vs. steel and cast iron (roughly 9-11 ppm/° C.) and the optimal coating choices will differ by engine material type and, in addition, the heat flux and, hence, thermal shock and the pressure pulse are much higher in diesel engines than other engines.

Embodiments of inventions described herein relate to a series of novel materials choices and material application methods to produce superior IC engine coatings. In some embodiments, these coatings may be applied by the thermal spray process. The thermal spray process includes plasma spray, high velocity oxygen fuel spray, flame spray, detonation gun spray and vacuum and inert environment plasma spray. Because the metal in IC engines are aggressively cooled, the difference in thermal expansion coefficient between the coating and the metal, although still important, is less important than in gas turbines.

Thermal spray (TS) can be done by the following spray technologies, Plasma spray, high velocity oxygen fuel spray (HVOF), subsonic oxygen fuel spray, air fuel spray often called flame spray and detonation gun spray. In embodiments of this invention, thermal spray is to be defined to specifically include any or all of these technologies. In addition, the materials can be delivered to the thermal spray torch in three different forms, as a powder (PS), as a suspension of the material (SP), and as chemical precursors that form the final materials in reactions occurring in the thermal spray plume (PR). PR specifically includes but is not limited to solution precursor plasma spray (SPPS) Each of the materials below is to be applied by any TS method using delivery to include PS, SP and PR except as noted.

Figure 3:
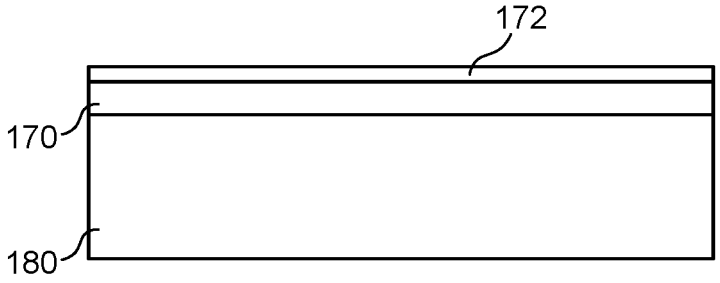
FIG. 3 depicts a schematic diagram illustrating an embodiment of a substrate with an insulating thermal spray coating in accordance with one or more embodiments of the present inventions.

Referring to FIG. 3, a schematic diagram illustrating an embodiment of a substrate 180 with an insulating thermal spray coating 170 is depicted. In the illustrated embodiment, the substrate 180 is a component or portion of an internal combustion engine. The thermal barrier coating includes an insulating thermal spray coating 170, where a chosen material of the insulating thermal spray coating 170 has a thermal conductivity lower than 2 W/mK in fully dense form and the chosen material includes a coefficient of thermal expansion within 5 ppm/K of a coefficient of thermal expansion of a material of a component of the internal combustion engine upon which the coating is placed. Various ranges are contemplated including a thermal conductivity lower than 1 W/mK, 2 W/mK, 3 W/mK, 5 W/mK, 10 W/mK, 20 W/mK, or 50 W/mK. Various ranges of CTE are contemplated including within 2 ppm/K, 5 ppm/K, 10 ppm/K, 20 ppm/K, or 50 ppm/K.

In some embodiments, the insulating thermal spray coating 170 comprises a perovskite material. In some embodiments, the perovskite material is of the $A_2B_2O_9$ category, where A and B are cations.

In some embodiments, the insulating thermal spray coating 170 comprises lanthanum molybdate ($La_2Mo_2O_9$). In some embodiments, the insulating thermal spray coating 170 comprises lanthanum molybdate ($La_2Mo_2O_9$) with at least one dopant, wherein the dopant is one of Bi, Ni, Rb, Y, Gd, Nd, Ba, Sr, Ca.

In some embodiments, the insulating thermal spray coating 170 comprises gadolinium zirconate ($Gd_2Zr_2O_7$).

In some embodiments, the insulating thermal spray coating 170 comprises lanthanum strontium cobalt ferrites, of the type $La_ySr_{1-y}Co_{1-x}Fe_xO_3$ oxides. In some embodiments, the x=0.4.

In some embodiments, the insulating thermal spray coating 170 comprises a material from the sodium zirconium phosphate ("NZP") class of ceramics that have a single crystal coefficient of thermal expansion below 5 ppm/K.

In some embodiments, the material from the sodium zirconium phosphate ("NZP") class of ceramics is one of $Sr_{0.5}Hf_2(PO_4)_3$, $Sr_{0.5}Zr_2(PO_4)_3$, $Ca_{0.25}Sr_{0.25}Zr_2(PO_4)_3$, $CsHf_2(PO_4)_3$, $Ca_{0.25}Sr_{0.25}Zr_2(PO_4)_3$, $Cs_{1.3}Gd_{0.3}Zr_{1.7}(PO_4)_3$.

In some embodiments, the insulating thermal spray coating 170 comprises calcium hexa-aluminate.

In some embodiments, the component or substrate 180 is steel and the insulating thermal spray coating 170 comprises a material from the sodium zirconium phosphate ("NZP") class of ceramics that have relatively low single crystal coefficient of expansion below 5 ppm/K.

In some embodiments, the material from the sodium zirconium phosphate ("NZP") class of ceramics is one of $Sr_{0.5}Hf_2(PO_4)_3$, $Sr_{0.5}Zr_2(PO_4)_3$, $Ca_{0.25}Sr_{0.25}Zr_2(PO_4)_3$, $CsHf_2(PO_4)_3$, $Ca_{0.25}Sr_{0.25}Zr_2(PO_4)_3$, $Cs_{1.3}Gd_{0.3}Zr_{1.7}(PO_4)_3$.

In some embodiments, the thermal barrier coating includes surface treatments through application of a top layer 172 to enhance smoothness or enhance erosion resistance or reduce surface porosity.

In some embodiments, the thermal barrier coating includes a material to absorb thermal radiation at or near a surface of the insulating thermal spray coating 170.

In some embodiments, the material to absorb thermal radiation is one of Phosphor bonded $Al_2O_3$, Phosphor bonded Cr or Fe doped $Al_2O_3$, Phosphor bonded $SiO_2$, Phosphor bonded Cr or Fe doped $SiO_2$, Phosphor bonded $ZrO_2$, Phosphor bonded Cr or Fe doped $ZrO_2$, or calcium magnesium aluminosilicate glass.

In some embodiments, the material further comprises silicon carbide or silicon nitride.

In some embodiments, the component is one of a piston crown, a combustion chamber, a valve face, an exhaust port, or an exhaust manifold section.

Figure 4:
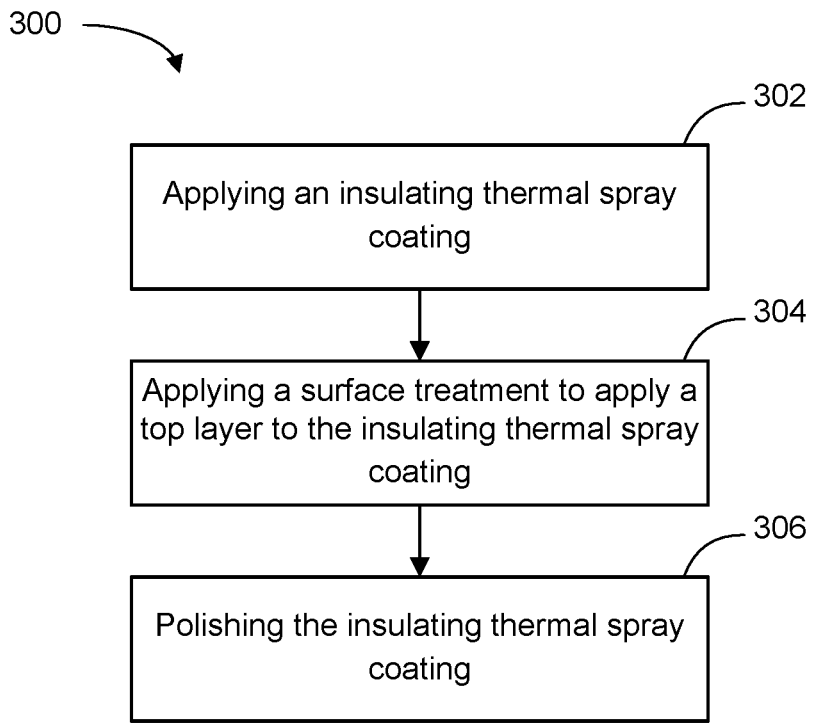
FIG. 4 depicts a flow chart diagram of a method for forming a thermal barrier coating in accordance with one or more embodiments of the present invention.

Referring now to FIG. 4, a method 300 for forming a thermal barrier coating is disclosed. The method includes applying 302 an insulating thermal spray coating where a chosen material of the insulating thermal spray coating has a thermal conductivity lower than 2 W/mK in fully dense form and the chosen material includes a coefficient of thermal expansion within 5 ppm/K of a coefficient of thermal expansion of a material of a component of the internal combustion engine upon which the coating is placed. At block 302, a surface treatment applies a top layer to the insulating thermal spray coating. At block 304, the insulating thermal spray coating is polished. The method then ends. Some embodiments may include only one or two of the depicted steps.

Although the foregoing disclosure provides many specifics, these should not be construed as limiting the scope of any of the ensuing claims. Other embodiments may be devised which do not depart from the scopes of the claims. Features from different embodiments may be employed in combination. The scope of each claim is, therefore, indicated and limited only by its plain language and the full scope of available legal equivalents to its elements.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

The present subject matter may be embodied in other specific forms without departing from its spirit or essential characteristics. The described embodiments are to be considered in all respects only as illustrative and not restrictive.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity This application is related to U.S. application Ser. No. 15/217,772, filed on Jul. 22, 2016, which is incorporated by reference herein in its entirety. This application also is related to U.S. application Ser. No. 14/181,574, filed on Feb. 14, 2014, which claims the benefit of priority of U.S. application No. 61/809,155, filed on Apr. 5, 2013. This application is related to U.S. application Ser. No. 15/268,341, filed on Sep. 16, 2016. This application is related to U.S. application Ser. No. 15/675,511, filed Aug. 11, 2017.

What is claimed is:

1. A thermal barrier coating for an internal combustion engine, comprising:

an insulating thermal spray coating, wherein:

a chosen material of the insulating thermal spray coating has a thermal conductivity lower than 2 W/mK in fully dense form; and the chosen material includes a coefficient of thermal expansion within 5 ppm/K of a coefficient of thermal expansion of a material of a component of the internal combustion engine upon which the coating is placed.

2. The thermal barrier coating of claim 1, wherein the insulating thermal spray coating comprises a perovskite material.

3. The thermal barrier coating of claim 2, wherein the perovskite material is of the $A_2B_2O_9$ category, where A and B are cations.

4. The thermal barrier coating of claim 1, wherein the insulating thermal spray coating comprises lanthanum molybdate ($La_2Mo_2O_9$).

5. The thermal barrier coating of claim 1, wherein the insulating thermal spray coating comprises lanthanum molybdate ($La_2Mo_2O_9$) with at least one dopant, wherein the dopant is one of Bi, Ni, Rb, Y, Gd, Nd, Ba, Sr, Ca.

6. The thermal barrier coating of claim 1, wherein the insulating thermal spray coating comprises gadolinium zirconate ($Gd_2Zr_2O_7$).

7. The thermal barrier coating of claim 1, wherein the insulating thermal spray coating comprises lanthanum strontium cobalt ferrites, of the type $La_ySr_{1-y}Co_{1-x}Fe_xO_3$ oxides.

8. The thermal barrier coating of claim 7, wherein the x=0.4.

9. The thermal barrier coating of claim 1, wherein the insulating thermal spray coating comprises a material from the sodium zirconium phosphate ("NZP") class of ceramics that have a single crystal coefficient of thermal expansion below 5 ppm/K.

10. The thermal barrier coating of claim 9, wherein the material from the sodium zirconium phosphate ("NZP") class of ceramics is one of $Sr_{0.5}Hf_2(PO_4)_3$, $Sr_{0.5}Zr_2(PO_4)_3$, $Ca_{0.25}Sr_{0.25}Zr_2(PO_4)_3$, $CsHf_2(PO_4)_3$, $Ca_{0.25}Sr_{0.25}Zr_2(PO_4)_3$, $Cs_{1.3}Gd_{0.3}Zr_{1.7}(PO_4)_3$.

11. The thermal barrier coating of claim 1, wherein the insulating thermal spray coating comprises calcium hexaaluminate.

12. The thermal barrier coating of claim 1, wherein the component is steel and the insulating thermal spray coating comprises a material from the sodium zirconium phosphate ("NZP") class of ceramics that have relatively low single crystal coefficient of expansion below 5 ppm/K.

13. The thermal barrier coating of claim 12, wherein the material from the sodium zirconium phosphate ("NZP") class of ceramics is one of $Sr_{0.5}Hf_2(PO_4)_3$, $Sr_{0.5}Zr_2(PO_4)_3$, $Ca_{0.25}Sr_{0.25}Zr_2(PO_4)_3$, $CsHf_2(PO_4)_3$, $Ca_{0.25}Sr_{0.25}Zr_2(PO_4)_3$, $Cs_{1.3}Gd_{0.3}Zr_{1.7}(PO_4)_3$.

14. The thermal barrier coating of claim 1, further comprising surface treatments through application of a top layer to enhance smoothness or enhance erosion resistance or reduce surface porosity.

15. The thermal barrier coating of claim 1, further comprising a material to absorb thermal radiation at or near a surface of the insulating thermal spray coating.

16. The thermal barrier coating of claim 15, wherein the material to absorb thermal radiation is one of Phosphor bonded $Al_2O_3$, Phosphor bonded Cr or Fe doped $Al_2O_3$, Phosphor bonded $SiO_2$, Phosphor bonded Cr or Fe doped $SiO_2$, Phosphor bonded $ZrO_2$, Phosphor bonded Cr or Fe doped $ZrO_2$, or calcium magnesium aluminosilicate glass.

17. The thermal barrier coating of claim 15, wherein the material further comprises silicon carbide or silicon nitride.

18. The thermal barrier coating of claim 1, wherein the component is one of a piston crown, a combustion chamber, a valve face, an exhaust port, or an exhaust manifold section.

19. A method for forming a thermal barrier coating, the method comprising:

applying an insulating thermal spray coating, wherein:

a chosen material of the insulating thermal spray coating has a thermal conductivity lower than 2 W/mK in fully dense form; and the chosen material includes a coefficient of thermal expansion within 5 ppm/K of a coefficient of thermal expansion of a material of a component of the internal combustion engine upon which the coating is placed.

20. The method of claim 19, further comprising polishing the insulating thermal spray coating.

* * * * *